US006401426B1

(12) United States Patent
Alderman et al.

(10) Patent No.: US 6,401,426 B1
(45) Date of Patent: Jun. 11, 2002

(54) METHOD OF DISPENSING NETTING FOR A ROOF STRUCTURE

(75) Inventors: Robert J. Alderman, Canyon Lake; James E. Taylor, Seguin, both of TX (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/602,754

(22) Filed: Jun. 23, 2000

Related U.S. Application Data

(60) Provisional application No. 60/141,428, filed on Jun. 29, 1999.

(51) Int. Cl.[7] ..... E04D 15/00

(52) U.S. Cl. ..... 52/749.12; 52/746.11; 52/745.06

(58) Field of Search ..... 52/746.11, 749.12, 52/745.06, 742.12, DIG. 12

(56) References Cited

U.S. PATENT DOCUMENTS 4,047,346 A 9/1977 Alderman
4,967,535 A 11/1990 Alderman
5,251,415 A 10/1993 Van Auken et al.
5,406,764 A 4/1995 Van Auken et al.
5,653,081 A 8/1997 Wenrick et al.
5,664,740 A * 9/1997 Alderman et al. ..... 242/592
5,778,628 A * 7/1998 Pendley ..... 52/749.12

* cited by examiner

*Primary Examiner*—Beth A. Stephan
*Assistant Examiner*—Naoko Slack
(74) *Attorney, Agent, or Firm*—Inger H. Eckert; Stephen W. Barns

(57) ABSTRACT

A method of dispensing netting on a roof structure to provide fall protection for workers on the roof structure is disclosed herein. The roof structure includes a plurality of purlins spaced apart from one another in a parallel arrangement. A carriage is provided which is moveable in a direction along the length of the purlins. A supply of netting is attached to the carriage. The carriage is then moved along the length of the purlins, wherein movement of the carriage dispenses the netting onto the end of the roof structure.

20 Claims, 6 Drawing Sheets

METHOD OF DISPENSING NETTING FOR A ROOF STRUCTURE

CROSS REFERENCE TO RELATED APPLICATIONS

This application claims the benefit of U.S. Provisional Application No. 60/141,428 filed Jun. 29, 1999.

TECHNICAL FIELD AND INDUSTRIAL APPLICABILITY OF THE INVENTION

This invention relates to the construction of an insulated metal roof structure for use in commercial and industrial buildings.

BACKGROUND OF THE INVENTION

Buildings having metal roof structures typically comprise a series of parallel rafter beams which are supported by vertical columns extending from the floor of the building. A plurality of spaced apart purlin beams extend in a direction normal to the rafter beams and are fastened to top portions of the rafter beams. Typically, the roofs generally have two sloped sections, each extending from a side of the building to a peak. To enclose the roof structure, sheets of hard roofing material, such as metal deck sheets can be used to cover the roof structure. The deck sheets are typically interlaced and fastened to the purlins.

Ordinarily, the roof structures include some type of insulation material placed above or below the deck sheets to provide thermal insulation for the building. In one type of insulated roof structure, insulation material in long sheets is placed in the area between purlins. The sheets of insulation material can be laid along the length of the purlins or across the purlins in a direction normal to the purlins. The insulation material is supported between the purlins beneath the hard roofing material. Various methods of supporting the insulation material have been used. Mounting straps or wire mesh which are attached to or draped over the purlins forming a lattice have been used. A facing or sheet, typically made of vinyl and acting as a vapor barrier, is then rolled onto the lattice, and insulation material is placed between adjacent purlins and over the sheet. Some systems dispense with the lattice and use the sheet itself to support the insulation material. The support sheet is dispensed from a roll and draped from adjacent purlins. Insulation material is then placed on top of the support sheet. A carriage has been used to aid in the dispensing of the support sheet, such as that disclosed in U.S. Pat. No. 4,967,535 to Alderman. The carriage is positioned on top of the purlins and travels the length of the purlins during the roof construction. A roll of the support sheet material is mounted on the carriage and the support sheet is dispensed from the roll and placed on top of the purlins. As the carriage travels the length of the purlins, the support sheet is draped across the purlins.

Of considerable importance to the construction of roof structures, is the safety of the workers. For roof structures which are built using the carriage as described above, it has been known to provide a platform which extends from the carriage in a direction towards the completed section of the roof and is pulled along with the carriage, such as that disclosed in U.S. Pat. No. 5,664,740 to Alderman et al. The platform extends underneath the purlins and supports the support sheet as it is loosely draped between adjacent purlins. The platform can be built of sufficient strength so as to support a worker stepping or falling onto the platform. However, the roof structures often include purlin support bracing and straps which extend between adjacent purlins. To accommodate the bracing, the platform is positioned near the top of the purlins so that the platform will not be obstructed by the bracing as the carriage moves. Thus, the support sheet is relatively flat across the tops of the purlins and does not hang down into the space between the purlins. Insulation material placed on top of the support sheet is then compressed when the hard roofing material is attached to the purlins. The use of platforms sufficiently built to support a worker adds weight to the carriage which may deform the purlins upon which the carriage is mounted.

In the past, permanent netting has been provided under the workers on top of the roof structure to help prevent the workers from falling between the purlins and to catch dropped objects, such as tools. U.S. Pat. No. 5,251,415 to Van Auken et al. discloses such a netting and method of installation. The netting is typically supplied in 30 feet wide sheets, which is the typical width between adjacent rafter beams. The netting can span the entire roof and can be placed in a secure but loose manner to support insulation material placed on top to provide space for the insulation material. When the insulation material and the deck sheets are installed above the netting, the netting becomes a permanent structure of the roof. To install the netting, the roll of netting is generally positioned on the ground with its axis parallel to the purlins. The leading edge of the netting is pulled up over the edge of the roof by workers which stand on top of the rafter beams. The workers then walk along the tops of the rafter beams and drag the netting across the purlins, so that the netting is laid longitudinally across the purlins from one edge of the building to the other. The netting is generally supplied in widths approximately equal to the expanse between rafter beams, commonly 30 feet so that the edges of the netting are positioned above a rafter beam. The edges of adjacent netting are fastened together, such as by use of tie straps or other fasteners to provide an edge to edge fastening strength as great as that of the netting itself. The netting is then secured to the roof structure by periodically strapping portions of the netting to purlins and rafter beams. Since the workers move along the rafter beams during the installation of the netting, there is a danger of falling off of the roof structure outside of the secured netting. To protect the workers, they are secured by lines or cords secured to the rafter beams and/or purlins. As the workers move along the rafter beams installing the netting, they must constantly change the connection point of the cord, which can be dangerous and time consuming.

Another method of installing the netting is to construct scaffolding underneath the roof structure to provide a platform for the workers installing the netting. Alternatively, lifting equipment can be used to hoist the workers up to the top of the roof structure to install the netting. However, the use of lifting equipment and scaffolding can be relatively expensive and time consuming.

It is also known to dispense netting onto a roof structure with the aid of a sled, such as that disclosed in U.S. Pat. No. 5,778,628 to Pendley. The sled includes a distribution box that holds a roll netting. The box has an open end through which the netting is dispensed. The sled includes a pair of spaced apart parallel rails for sliding along the tops of the purlins. The rails have a length which is longer than two purlin spans to prevent the sled from falling therebetween. To dispense the netting, the sled is positioned across the purlins and pulled by a rope in a direction perpendicular to the length of the purlins. As the sled is moved, the netting is dispensed from the open end of the box. The width of the netting is preferably sized to correspond with the width of the bays of the roof, i.e., the width between the rafter beams. The netting is then secured to the roof structure by periodically strapping portions of the netting to purlins and/or rafter beams. Since the workers move along the rafter beams during the installation of the netting, there is a danger of falling off of the roof structure outside of the secured netting. If the roof structure were to include fibrous insulation, the insulation is installed on top of the netting between adjacent purlins. Preferably, the netting is not taut between the purlins, but rather sags therebetween to provide vertical space for the fibrous insulation material. It is difficult to accomplish this sagging by the use of the sled since the sled is pulled along a direction perpendicular to the purlins.

It would be desirable to have a system of building roof structures which is simple and less time consuming to use, and which provides adequate protection from falling objects and for the workers constructing the roof.

SUMMARY OF THE INVENTION

The above objects as well as other objects not specifically enumerated are achieved by a method of dispensing netting on a roof structure to provide fall protection for workers on the roof structure. The roof structure includes a plurality of purlins spaced apart from one another in a parallel arrangement. A carriage is provided which is moveable in a direction along the length of the purlins. A supply of netting is attached to the carriage. Preferably, the supply of netting is supplied in rolls which are rotatably mounted on the carriage. The carriage is then moved along the length of the purlins such that movement of the carriage dispenses the netting onto the roof structure.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
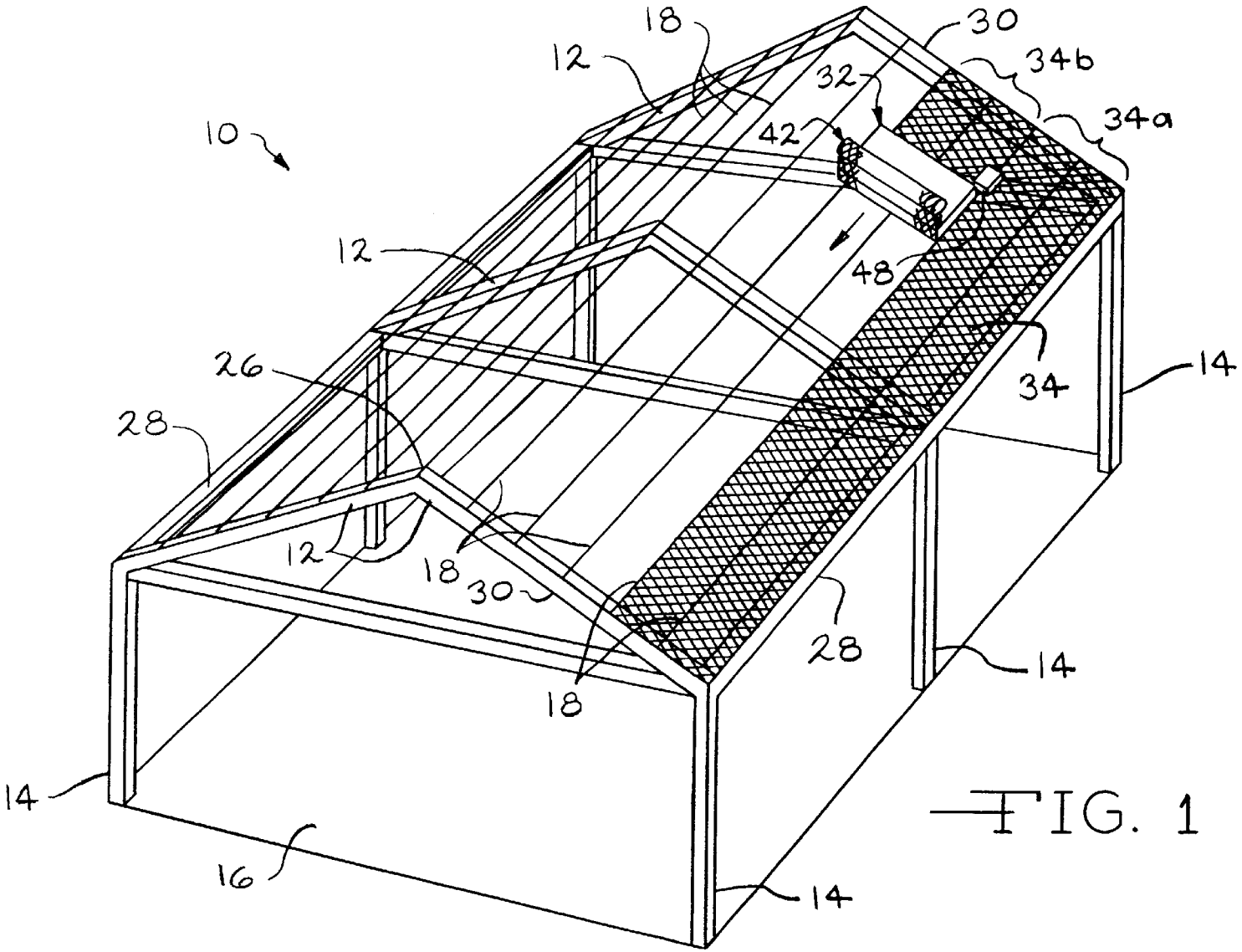
FIG. 1 a chematic perspective view of a roof structure wherein a carriage is traveling along the roof structure for dispensing a netting, in accordance with the present invention.
Figure 2:
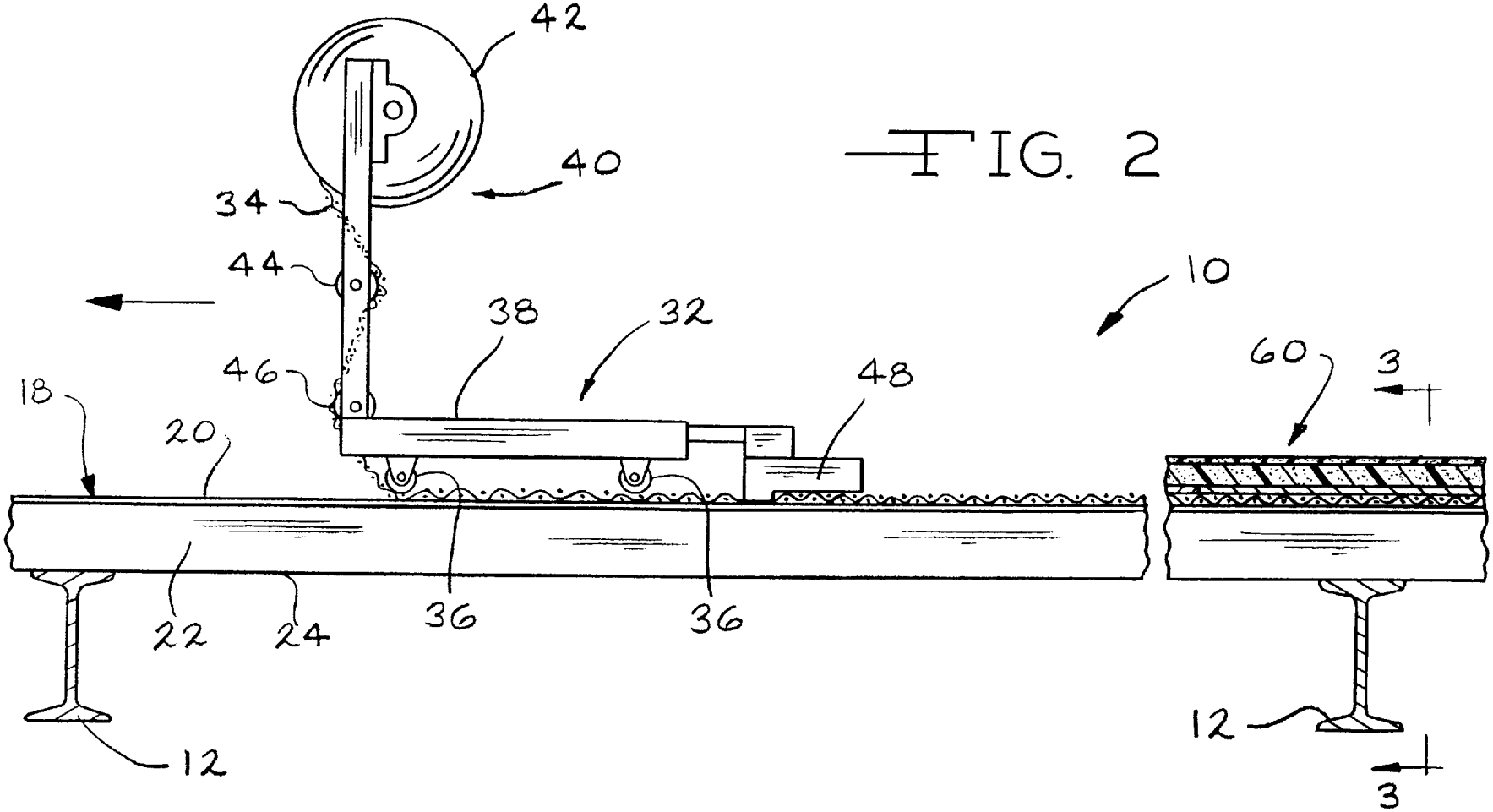
FIG. 2 a side elevational view of the roof structure and carriage of FIG. 1.
Figure 3:
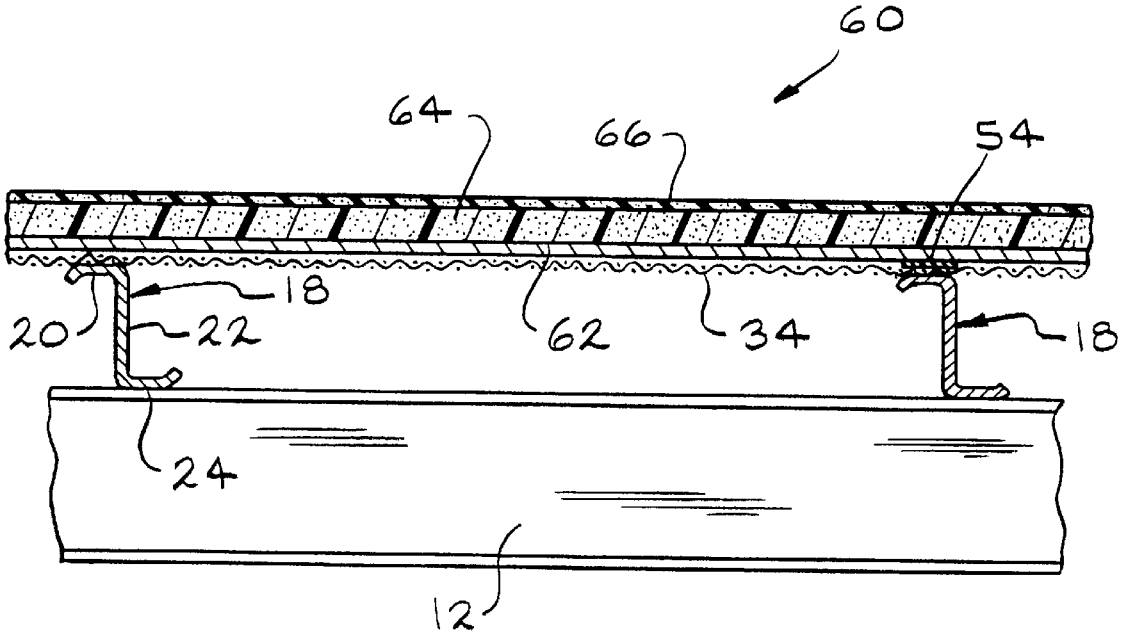
FIG. 3 is a sectional view of the roof structure taken along Lines 3—3 of FIG. 2.
Figure 4:
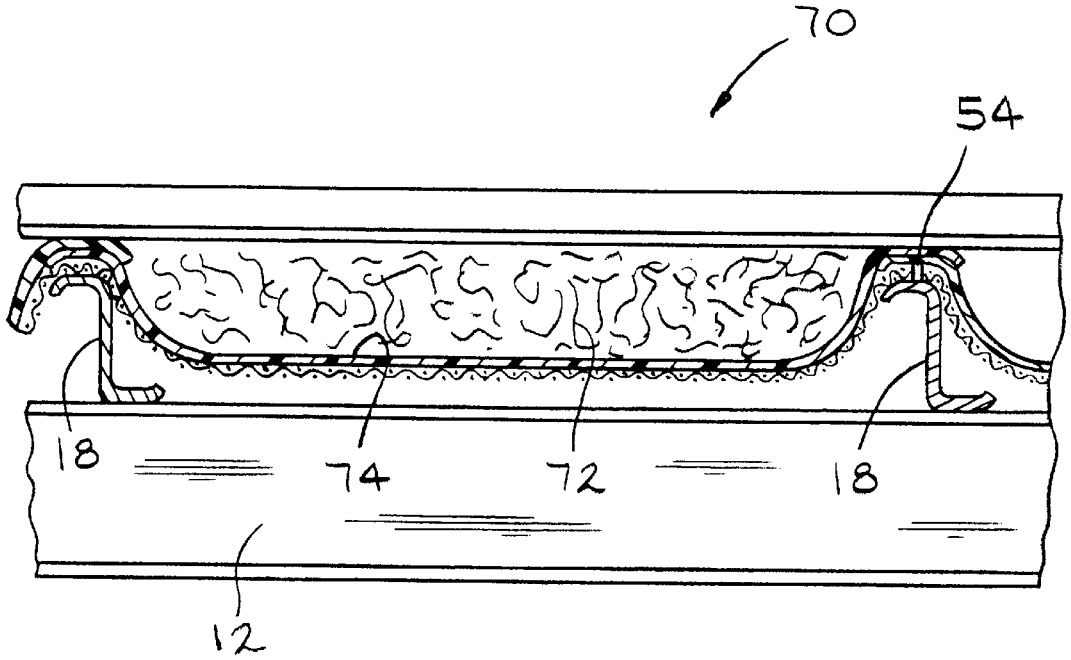
FIG. 4 is a sectional view of an alternate embodiment of a roof structure.

Referring now to the drawings, there is illustrated in FIGS. 1 and 2 a partially constructed building roof structure, indicated generally at 10. The roof structure is supported by a building framework which includes main rafter beams 12 positioned parallel to each other and supported by vertical columns 14 extending upward from a floor 16. A plurality of purlins 18, spaced apart and arranged parallel to each other, is fastened on top of the rafters in a direction normal to the rafters. The purlins typically have a generally Z-shaped cross-section, and include a horizontally extending upper portion 20, a vertically extending web 22, and a horizontally extending lower portion 24, as best shown in FIGS. 3 and 4. Roof structures may also be constructed from bar joists or trusses, and the invention as described herein will work equally well with purlins, bar joists or trusses. The use of the term "purlins" in this specification and claims includes not only traditional purlins, but also joists, trusses, and other similar structural members. As shown in FIG. 1, the building framework has two sloped roof sides which are joined together to form a peak 26. Thus, the framework has successive adjacent purlins which are positioned lower than the peak as their distance from the peak increases. The peak 26 can be formed by a pair of adjacent purlins. The spacing between adjacent purlins is typically 5 feet (1.52 m) on centers. The sides of the roof structure 10 have eave struts 28 fastened to the rafters and extending parallel to the purlins. Commonly, eave struts have a C-shaped cross-section. Each of the sloped sides of the roof structure define ends 30, which typically include a rake angle having an L-shaped cross-section. The roof structure 10, as shown in FIG. 1, includes a pair of bays for each slope. A bay is defined as the area of a slope between adjacent rafter beams. Although the roof structure 10 of FIG. 1 includes two bays for each slope with six purlin spacings in each slope, it should be understood that the method of dispensing a netting as described herein can be practiced on a roof structure having any number of bays, slopes, and purlin spacings.

As stated above, of considerable importance to the construction of roof structures, is the safety of workers. The method of the present invention dispenses a netting onto the roof structure to help prevent workers working on the roof structure from falling onto the ground below. The netting may also help prevent objects, such has tools, from falling from the roof structure onto workers on the ground.

As shown in FIGS. 1 and 2, a carriage, indicated generally at 32, is used to dispense netting 34 on the roof structure. The carriage rides on top of the purlins 18 and travels along the length of the purlins in a direction between the ends 30 of the roof structure. The carriage 32 can be any suitable apparatus that rides along the top of the purlins for dispensing the netting. The carriage 32 can be propelled along the roof structure by any suitable pulling means, such as by a winch (not shown) and a cable (not shown) fastened to the ends 30 of the roof structure. The carriage 32 can also be propelled by a powered puller assembly (not shown) which rides along the purlins pulling the carriage along with it. The carriage 32 preferably has rollers 36 rotatably mounted thereon to roll along the upper portions 20 of the purlins 18. The carriage 32 can be any length up to the width of the roof structure. As shown in FIG. 1, the carriage 32 generally spans the width of two purlin spans. If desired, a plurality of carriages 32 can be joined together to span the entire width of the slope of the roof to dispense the netting 34 along the entire width of the roof. The carriage 32 preferably includes a generally horizontal platform 38 for supporting workers thereon. If desired, a guardrail (not shown) can be mounted on the platform 38 to help prevent the workers from inadvertently falling on the exposed portion of the roof structure. The carriage 32 may also include a stitching machine 48 for attaching longitudinal edges of adjacent strips or lengths of netting, as will be described in detail below.

Preferably, the carriage 32 includes a dispenser, indicated generally at 40 mounted on the carriage 32. The dispenser 40 can be any suitable apparatus for supporting and permitting the dispensing of a supply of netting 34. For example, the netting can be supplied in a roll 42 rotatably mounted on the dispenser 40. As the carriage moves along the length of the purlins, the netting 34 is dispensed from the roll 42 and draped on top of adjacent purlins 18. Preferably, the netting 34 is directed around guide rollers 44 and 46 and underneath the rollers 36.

To dispense the netting 34 onto the roof structure 10, an end of the roll of netting is first attached to the end 30 of the roof structure 10. The end of the netting 34 can be attached to the end of the roof structure 10 by any suitable manner, such as by clips or other mechanical fasteners. Once the end of the netting 34 is secured, the carriage 32 is propelled across the roof structure along the length of the purlins in a direction towards the other end 30 of the roof structure. As the carriage is moved, the netting 34 is dispensed along the length of the purlins. If desired, the dispenser 40 can include a clutch mechanism for maintaining tension on the netting as the netting is dispensed. Once the carriage 32 reaches the end 30 of the roof structure 10, the netting can be cut from the roll 42 and fastened to the end 30 of the roof structure. Although the netting is secured at its ends along the ends 30 of the roof structure 10, portions of the netting can be attached to the purlins 18, the rafter beams 12, the eave struts 28, or the peak 26 to further secure the netting. For example, if the netting is laid adjacent the eave strut 28, the longitudinal edge of the netting 34 adjacent the eave strut 28 can be fastened thereto. The netting can be fastened to the various structures of the roof structure 10 by any suitable manner, such as by clips or other mechanical fasteners.

Although the netting is described above as being dispensed from one end 30 of the roof structure to the other end, the netting can be dispensed from only a portion of the roof structure 10 to another portion. For example, the netting can be dispensed from one rafter beam 12 to another to cover one bay of the roof structure.

If the width of the netting is less than the width of the slope of the roof structure, such as the embodiment of the netting 34 shown in FIG. 1, the carriage 32 can make multiple passes between the ends 30 to cover the entire slope of the roof structure 10. For example, as shown in FIG. 1, the carriage 32 first dispenses a first length of netting, indicated at 34*a*. After dispensing the first length of netting 34*a*, the carriage is moved laterally along the end 30 of the roof structure and placed in a position on the purlins to dispense a second length of netting 34*b* in a direction towards the other end 30. The carriage 32 is positioned such that a longitudinal edge of the first length of netting 34*a* is adjacent the longitudinal edge of the second length of netting 34*b*. Preferably, the carriage 32 is lightweight so that the carriage 32 can be manually lifted and placed into position to dispense successive lengths of netting. The carriage 32 could also be moved by the aid of a crane or other construction lifting equipment. Once the carriage 32 is properly positioned, the end of the roll of netting is fastened to the end 30 of the roof structure 10. The carriage is then propelled along the length of the purlins to dispense the second length of netting 34*b* in a similar manner as dispensing the length of netting 34*a* described above. These steps are repeated to dispense netting across the entire roof structure.

Figure 5:
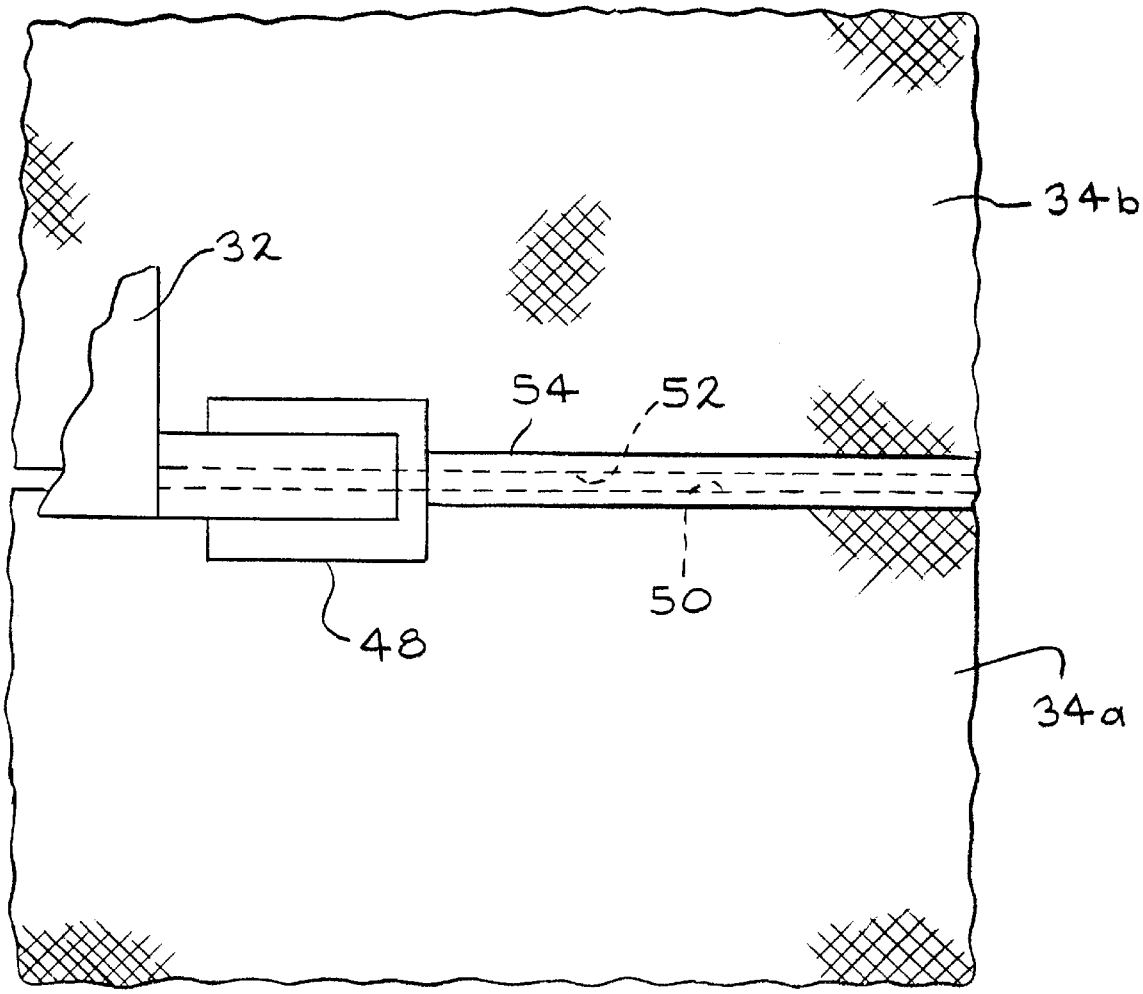
FIG. 5 is a schematic plan view illustrating adjacent edges of netting being fastened together.

Although the lengths of netting are secured at their ends along the ends 30 of the roof structure, it is also desirable to fastened the longitudinal edges of adjacent lengths of netting together to form a seam which is preferably as strong as the netting material itself. The netting can be joined or fastened together as the netting is dispensed while the carriage travels along the length of the purlins. As schematically illustrated in FIG. 5, the first and second lengths of netting 34*a* and 34*b* are positioned such that a longitudinal edge 50 of the first length of netting 34*a* is positioned adjacent a longitudinal edge 52 of the second length of netting 34*b*. The edges 50 and 52 are joined together to form a seam, schematically represented at 54 in FIG. 5. The seam 54 can be formed by any suitable manner. For example, workers standing on the platform 38 of the carriage 32 can manually fasten the edges 50 and 52 together with mechanical fasteners, such as with ties, cords, hog rings, or clips. The netting can also be secured periodically to the purlins 18 or the rafter beams 12. The edges 50 and 52 can also be fastened together by forming the seam 54 by stitching. The stitching can be manually done by workers on the platform or, alternatively, by the stitching machine 48. The stitching machine 48 is mounted on the carriage 32 and can stitch or otherwise fasten the edges 50 and 52 together automatically as the second length of netting 34*b* is dispensed. Other examples of forming a seam 54 would be using strips fastened to the edges 50 and 52 having mating features, such as hook and loop fasteners, snaps, buttons, zipper mechanisms, or any other suitable closure structures. Although the edges 50 and 52 are shown adjacent each other in close proximity when the lengths of the netting are dispensed, it should be understood that the edges could overlap.

The netting 34 can be any suitable mesh or web material, such as a polymer scrim material, which is preferably sufficiently strong enough to support the weight of a worker inadvertently falling onto the netting. The mesh of the netting can also be made small enough to catch falling objects, such as various tools and fasteners, which are inadvertently dropped from above the netting, to protect the workers below the roof structure. By dispensing the netting underneath the rollers 36 of the carriage, the weight of the carriage helps to securely retain or support the netting on top of the purlins. If the carriage is propelled by a winch and cable (not shown), the cable also helps to maintain the position of the carriage on the roof structure to secure the netting if the netting was to be pulled by the weight of a worker who has inadvertently falling onto the netting. Thus, the netting is generally secured by the carriage on one end and fastened to the end of the roof structure on the other end. If a powered puller device (not shown) is used to propel the carriage, the puller device is preferably engageable to a clamped position to secure the carriage to the purlins.

Although the netting has been shown and described as being dispensed from rolls, it should be understood that the netting can be supplied in any suitable format which permits the netting to be payed out from the moving carriage. For example, the netting could be supplied in an accordion-style folded manner which spreads out as the netting is dispensed. If the netting is supplied on rolls, the rolls do not have to be rotatably mounted on the carriage, but can be simply laid on top of the purlins and pulled by the carriage. The netting may also be of an expandable type or controlled mesh spacing type, commonly referred to as a "widener mesh", which can expand or spread out in a lateral and/or longitudinal direction. These types of netting include expandable threads or are specially woven which permit expansion of the netting. If desired, the netting can be manufactured to include expandable regions corresponding to the position between the purlins.

An alternative to dispensing netting from a roll 42 is to mount a portable netting machine (not shown) on the carriage 32. The netting machine would produce or stitch a netting from individual spools of string or cord and dispense the netting as the carriage travels along the purlins. Different types of netting can be created for different types of roof structures. For example, the mesh spacing or types of string or cord can be controlled for aesthetic purposes.

After the netting is dispensed or during the netting installation, an insulated or non-insulated portion of the roof structure 10 can be constructed. An example of a non-insulated roof is to simply fasten hard roofing sheets to the upper portions 30 of the purlins 18 to completely cover the roof structure. There is illustrated in FIGS. 2 and 3 a first embodiment of a completed insulated roof structure, indicated generally at 60. The roof structure 60 includes a plurality of metal deck sheets 62 which are fastened to the upper portions 30 of the purlins 18. The metal deck sheets 62 are preferably overlapped and applied with a sealant between the overlapped portions to provide a generally watertight seal. Rigid insulation board 64 is placed on top of the metal deck sheets 62. A waterproof membrane 66 is then applied on top of the rigid insulation board, thereby forming a waterproof roof structure. The workers can stand on the deck sheets once they are fastened to the purlins to install the insulation board 64 and the waterproof membrane 66. The netting 34 provides fall protection for the workers on the deck sheets.

There is illustrated in FIG. 4 a second embodiment of a completed insulated roof structure, indicated generally at 70. The roof structure 70 includes a layer of insulation material 72, such as fibrous insulation material. The insulation material is supported by a layer of facing 74. The facing 74 depends from the upper portions 20 of the purlins 18 so that the facing sags between adjacent purlins. The sagging provides space for the fibrous insulation. The facing can be any suitable material, such as vinyl, which supports the insulation material between the purlins. The facing can also be used as a vapor barrier and/or for aesthetic appearances.

Figure 6:
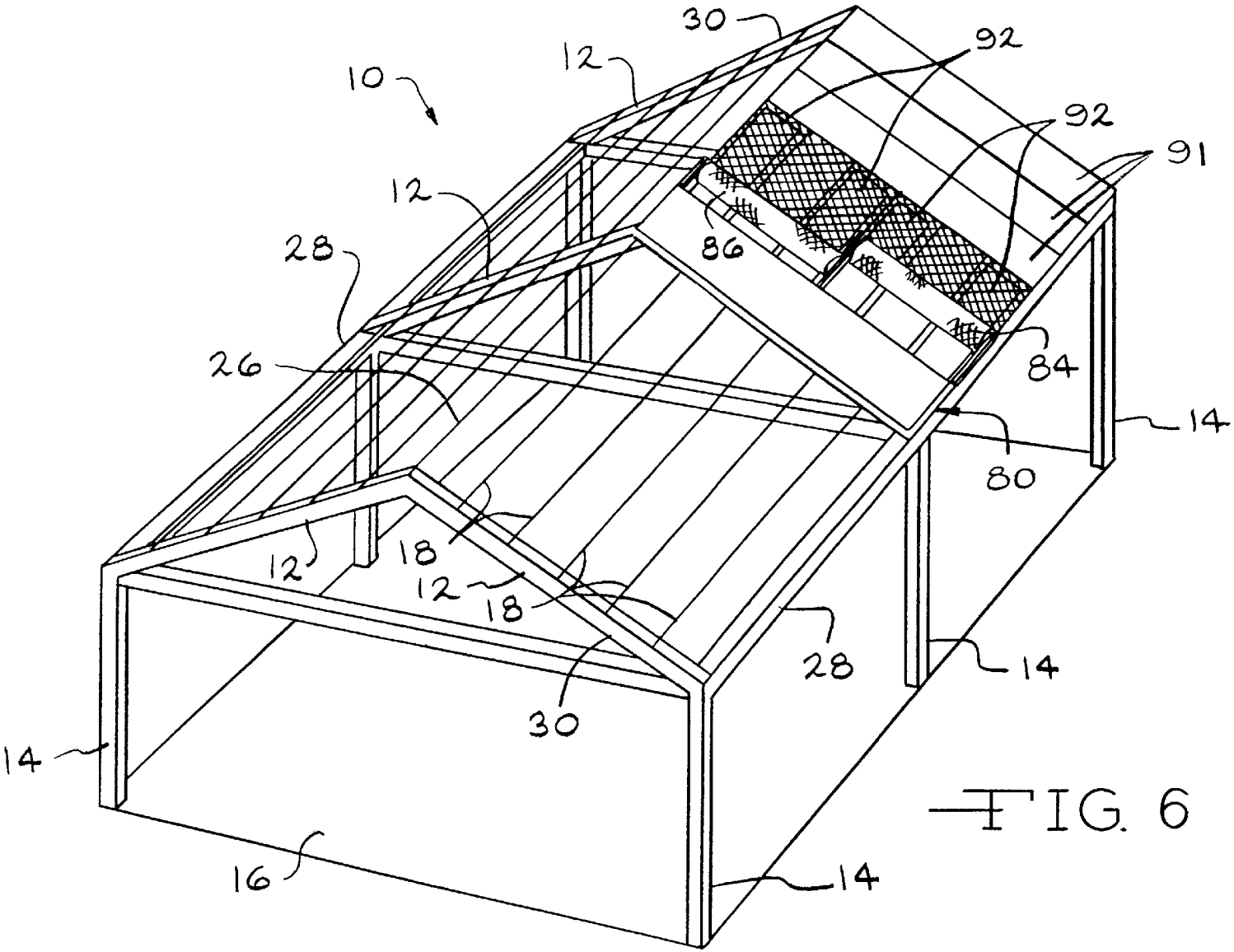
FIG. 6 is a schematic perspective view of the roof structure of FIG. 1 illustrating an alternate method of dispensing a netting by means of a platform, in accordance with the present invention.
Figure 7:
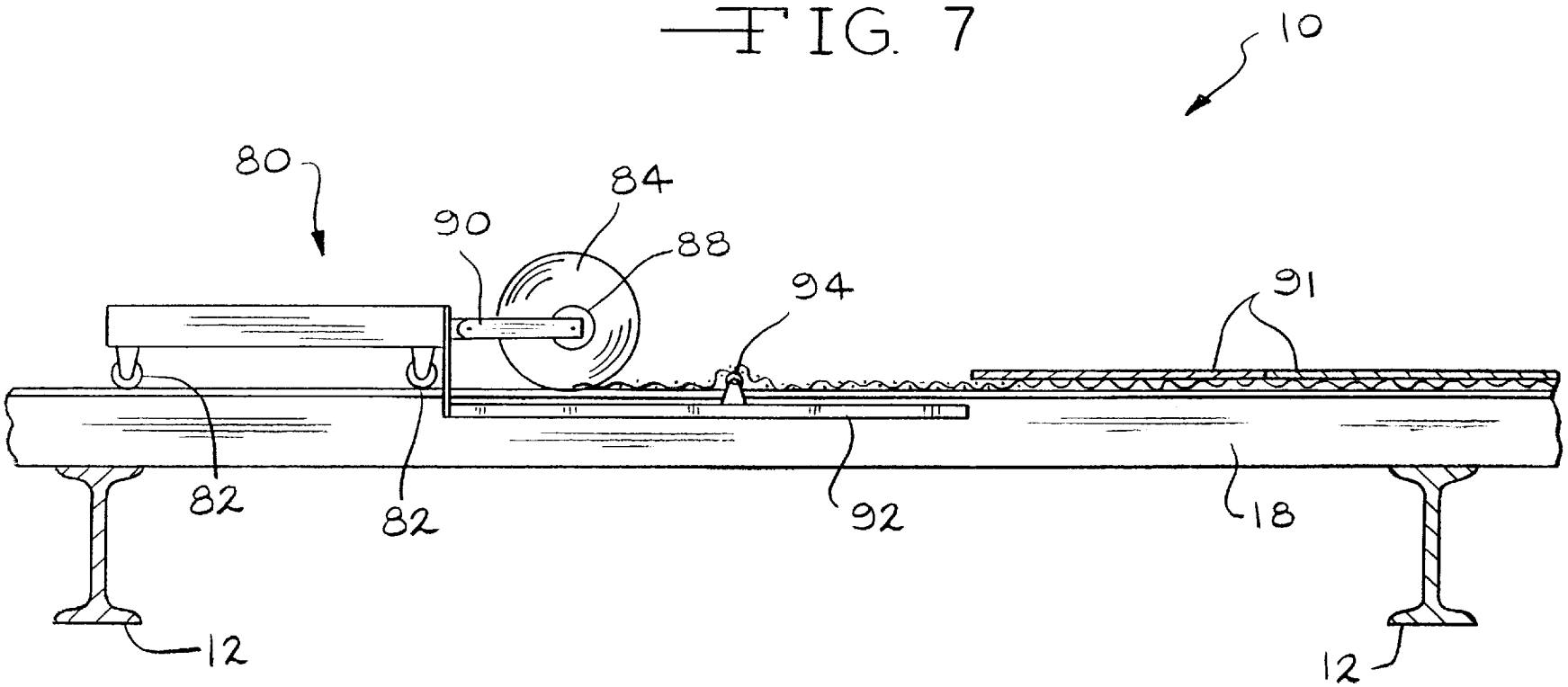
FIG. 7 is a side elevational view of the roof structure and platform of FIG. 6.

There is illustrated in FIGS. 6 and 7 the roof structure 10 illustrating an alternate method of dispensing netting by means of a carriage or platform, indicated generally at 80. The platform 80 rides on top of the purlins 18 and travels along the length of the purlins in a direction between the ends 30 of the roof structure. The platform 80 can be any suitable apparatus that rides along the top of the purlins. The platform 80 can be propelled along the roof structure by any suitable pulling means, such as by a winch and a cable (not shown) fastened to the ends 30 of the roof structure. The platform can also be propelled by a powered puller assembly (not shown) which rides along the purlins pulling the carriage along with it. The platform preferably has rollers 82 rotatably mounted thereon to roll along the upper portions 20 of the purlins 18. Although the platform 80 is shown having a width as wide as one slope of the roof structure 10, the platform can have any width. Preferably, the platform is adapted to support workers thereon. If desired, a guardrail (not shown) can be mounted on the platform to help prevent the workers from inadvertently falling on the exposed portion of the roof structure.

Fastened to the platform 80 are first and second rolls of netting 84 and 86. The rolls of netting 84 and 86 are laid directly on top of the purlins. Preferably the rolls of netting are mounted on a relatively rigid mandrel 88 having ends which are fastened to the platform 80. The rolls of netting can be fastened to the platform by any suitable manner, such as by cables or straps 90. The rolls of netting are pulled along by the platform when the platform is propelled along the length of the purlins. Preferably the rolls of netting are 84 and 86 are dispensed such that their longitudinal edges are adjacent one another. The edges of the netting 84 and 86 can be joined together by any suitable manner, such as by stitching, as described above with respect to the lengths of netting 34*a* and 34*b*. Also, portions of the netting can be attached to the purlins 18, the rafter beams 12, or the eave struts 28 if so desired.

The netting 84 and 86 can be fastened to the end 30 of the roof structure to support the netting. Alternatively, deck sheets 91 can be installed over the netting and fastened to the upper portions 20 of the purlins 18. Thus, the deck sheets 91 will secure the netting 84 and 86 to the roof structure. The workers can stand on the deck sheets 91 to fasten or join the edges of the netting together. To provide fall protection for the workers at the areas of the roof adjacent the edges of the netting, the platform 90 can include optional plates 92. The plates 92 extend outwardly from the platform 80 in a direction opposite the direction of travel of the platform during dispensing of the netting. The plates 92 have a width which is generally equal to a purlin span and are positioned on the platform between adjacent purlins. The plates 92 provide fall protection for workers which are working on the roof structure 80. Preferably, each plate includes wheels 94 which support the plate by rolling along the upper portions 20 of the purlins 18. Although the platform can include any number of plates, it is desirable to provide plates 92 at the vicinity of the edges of the netting, as shown in FIG. 6. If workers are manually joining the edges of the netting together, the plates help reduce the likelihood of a fall since the edges of the netting may not have been joined yet. Preferably, the platform is moved only so far away from the installed deck sheets 91 so that the length of the plates 92 spans the area between the rolls of netting 84 and 86 and the edge of the last attached deck sheet 91, as shown in FIG. 7. Although the netting can be secured to the purlins, the rafter beams, the eave struts, or the peak, the use of plates 92 provides fall protection so that the netting does not have to be attached to the roof structure other than under the deck sheets 91, thereby reducing the time and labor costs of securing the netting to the roof structure.

The platform 80 may include a stitching machine, such as the stitching machine 48 described above, for automatically attaching the longitudinal edges of adjacent strips or lengths of netting as the netting is dispensed The principle and mode of operation of this invention have been described in its preferred embodiments. However, it should be noted that this invention may be practiced otherwise than as specifically illustrated and described without departing from its scope.

What is claimed is:

1. A method of dispensing netting on a roof structure having a plurality of purlins spaced apart from one another in a parallel arrangement, the method comprising:

a. providing a carriage moveable in a direction along the length of the purlins;

b. providing a first supply of netting attached to the carriage;

c. providing a second supply of netting attached to the carriage;

d. moving the carriage in a direction along the length of the purlins, wherein movement of the carriage dispenses the netting on top of the purlins.

e. simultaneously fastening together the edges of the first and second supplies as the carriage moves along the purlins.

2. The method of claim 1, wherein the netting is supplied on a roll which is mounted on the carriage.

3. The method of claim 1, wherein the netting is supplied on a roll positioned on top of the purlins.

4. The method of claim 1 further including the step of securing the netting to the purlins subsequent to the dispensing of the netting.

5. The method of claim 1, wherein the plurality of purlins are coplanar with one another and define a slope of the roof, the netting and the slope of the roofs having widths extending normal to the direction along the length of the purlins, and wherein the width of the netting is at least as wide as the width of the slope of the roof.

6. The method of claim 1 further including the step of fastening deck sheets on top of the purlins above the netting.

7. The method of claim 6, wherein the step of fastening deck sheets on top of the purlins secures an end of the netting to the roof structure.

8. The method of claim 1, wherein the netting is expandable in a lateral direction normal to the direction along the length of the purlins.

9. The method of claim 1 wherein the carriage is provided with a platform adapted to support workers.

10. The method of claim 1, wherein the supply of netting defines a first supply of netting, the method further comprising providing a second supply of netting attached to the carriage, wherein movement of the carriage dispenses the first and second supplies of netting such that edges of the first and second supplies of netting are dispensed adjacent one another.

11. The method of claim 10 further including the step of fastening the adjacent edges of the first and second supplies of netting together.

12. The method of claim 11, wherein the edges of the first and second supplies of netting are fastened together by mechanical fasteners.

13. The method of claim 11, wherein the edges of the first and second supplies of netting are fastened together by stitching.

14. The method of claim 10, wherein the carriage is provided with a plate extending outwardly from the carriage in a direction opposite the direction of the movement of the carriage, and wherein the plates are adapted to provide fall protection for workers working on the roof structure.

15. The method of claim 14, wherein the plate is positioned between adjacent purlins.

16. A method of dispensing netting on a roof structure having a plurality of purlins spaced apart from one another in a parallel arrangement, the method comprising:

a. providing a carriage and a first and second supply of netting attached to the carriage, the netting having longitudinal edges;

b. moving the carriage in a first direction along the length of the purlins from a first portion of the roof structure to a second portion of the roof structure, wherein movement of the carriage dispenses a first length of netting between the first and second portions of the roof structure;

c. moving the carriage along the second portion of the roof structure in a direction normal to the first direction;

d. moving the carriage in a second direction opposite the first direction along the length of the purlins from the second portion of the roof structure to the first portion of the roof structure, wherein movement of the carriage dispenses a second length of the netting between the second and first portions of the roof structure such that a longitudinal edge of the first length of netting is positioned adjacent a longitudinal edge of the second length of netting; and e. simultaneously fastening the adjacent longitudinal edges of the first and second lengths of netting together as the carriage moves along the purlins.

17. The method of claim 16, wherein the longitudinal edges of the first and second lengths of netting are fastened together by stitching.

18. The method of claim 16, wherein the longitudinal edges of the first and second lengths of netting are fastened together by mechanical fasteners.

19. The method of claim 16, wherein the netting is dispensed from the carriage such that the netting sags between adjacent purlins.

20. The method of claim 16, wherein the netting is dispensed from the carriage such that the netting sags between adjacent purlins.

* * * * *